US008244160B2

(12) United States Patent
Suzuki et al.

(10) Patent No.: US 8,244,160 B2
(45) Date of Patent: Aug. 14, 2012

(54) DEVELOPING DEVICE AND IMAGE FORMING APPARATUS

(75) Inventors: Shiro Suzuki, Ebina (JP); Atsushi Ogihara, Ebina (JP); Masahiro Sato, Ebina (JP); Atsuyuki Kitamura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 370 days.

(21) Appl. No.: 12/705,442

(22) Filed: Feb. 12, 2010

(65) Prior Publication Data

US 2011/0052264 A1 Mar. 3, 2011

(30) Foreign Application Priority Data

Aug. 25, 2009 (JP) ..... 2009-194191

(51) Int. Cl.
*G03G 15/01* (2006.01)

(52) U.S. Cl. ..... 399/227

(58) Field of Classification Search ..... 399/227, 399/226, 223, 53
See application file for complete search history.

(56) References Cited

U.S. PATENT DOCUMENTS

| | | | | |
|---|---|---|---|---|
| 4,622,916 | A * | 11/1986 | Tanaka et al. | 399/227 |
| 4,652,113 | A * | 3/1987 | Watanabe | 399/227 |
| 4,697,915 | A * | 10/1987 | Hayashi et al. | 399/227 |
| 4,713,673 | A * | 12/1987 | Kessoku | 399/227 |
| 4,792,825 | A * | 12/1988 | Saito et al. | 399/227 |
| 5,724,634 | A * | 3/1998 | Maruta | 399/227 |
| 5,761,576 | A * | 6/1998 | Sugihara et al. | 399/227 |
| 6,185,396 | B1 * | 2/2001 | Aizawa et al. | |
| 2003/0026627 | A1 * | 2/2003 | Kishigami et al. | 399/227 |
| 2004/0208673 | A1 * | 10/2004 | Kishigami et al. | 399/227 |

FOREIGN PATENT DOCUMENTS

JP 2002-311675 A 10/2002

* cited by examiner

*Primary Examiner* — Susan Lee
(74) *Attorney, Agent, or Firm* — Sughrue Mion, PLLC

(57) ABSTRACT

A developing device includes: plural developing units; a rotary body, where the plural developing units are attached, that rotates so as to place one of the plural developing units in a developing position to develop a subject of development; a first driving unit that drives the rotary body; a second driving unit that drives at least one of the plural developing units; and a regulatory mechanism that regulates a position of the rotary body using a rotational force caused in the rotary body in accordance with driving by the second driving unit.

7 Claims, 9 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2009-194191 filed Aug. 25, 2009.

BACKGROUND

Technical Field

The present invention relates to a developing device and an image forming apparatus.

SUMMARY

According to an aspect of the present invention, there is provided a developing device including: plural developing units; a rotary body, where the plural developing units are attached, that rotates so as to place one of the plural developing units in a developing position to develop a subject of development; a first driving unit that drives the rotary body; a second driving unit that drives at least one of the plural developing units; and a regulatory mechanism that regulates a position of the rotary body using a rotational force caused in the rotary body in accordance with driving by the second driving unit.

BRIEF DESCRIPTION OF THE DRAWINGS

Exemplary embodiments of the present invention will be described in detail based on the following figures, wherein.

DETAILED DESCRIPTION

Next, exemplary embodiments of the present invention will be described based on the drawings.

Figure 1:
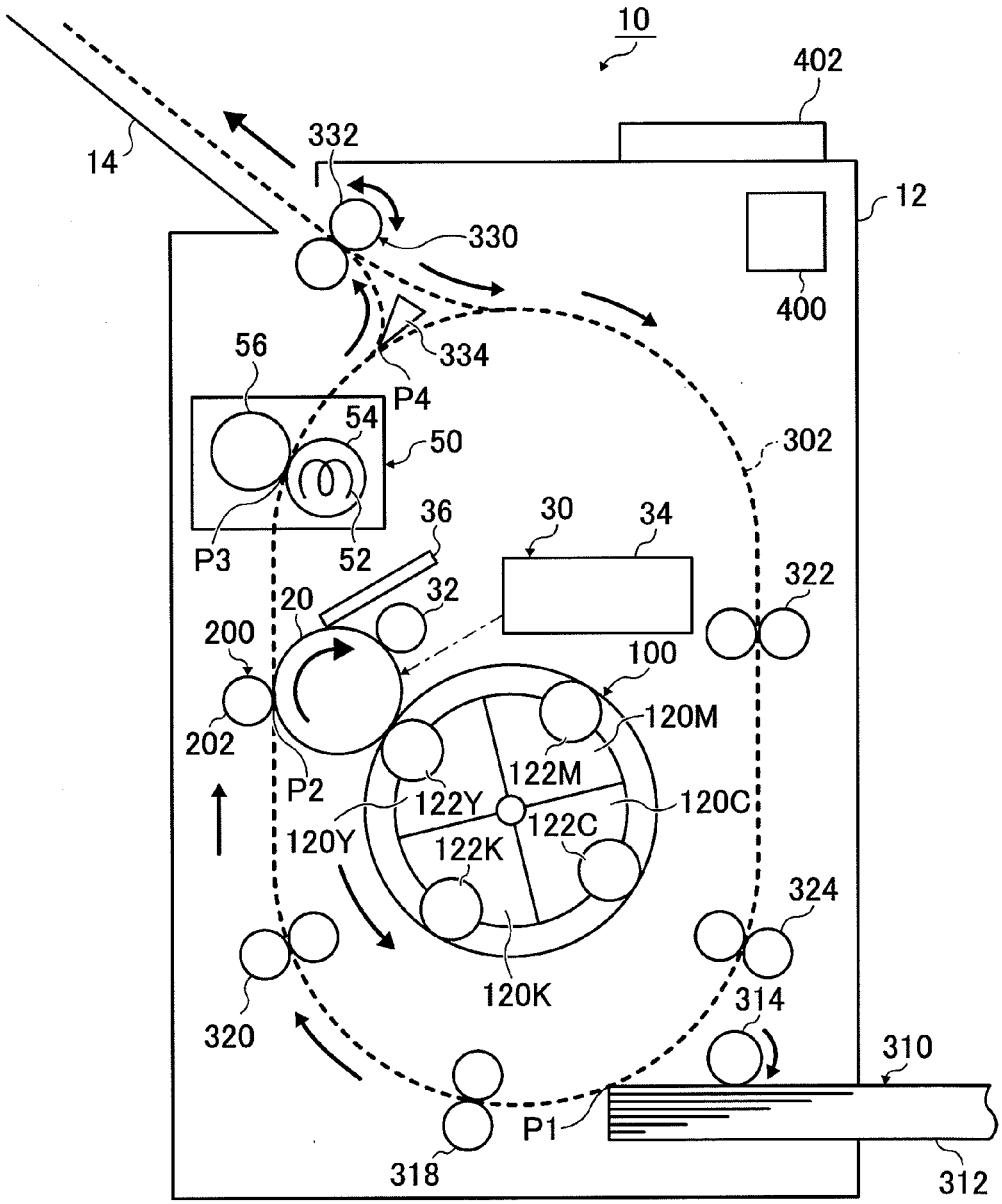
FIG. 1 is a right side cross-sectional view showing a structure of an image forming apparatus according to a first exemplary embodiment of the present invention.

FIG. 1 shows an image forming apparatus 10 according to a first exemplary embodiment of the present invention. The image forming apparatus 10 has an image forming apparatus main body 12. A photoreceptor drum 20 which is used as an image holding member to hold at least a latent image and used as a subject of development as well as an image forming part 30 to form an image on the photoreceptor drum 20 are attached in the image forming apparatus main body 12. Further, an endless transport passage 302 for transport of a recording sheet which is used as a recording medium and used as a transfer medium is formed in the image forming apparatus main body 12. Further, a sheet supplying device 310 to supply a recording sheet to the transport passage 302 is attached in the image forming apparatus main body 12. Further, a fixing device 50 to fix a toner image to a recording sheet is attached in the image forming apparatus main body 12.

Further, an operation panel 402 used as an operation device is attached on an outer wall of the image forming apparatus main body 12. Further, a reverse device 330, which discharges a recording sheet from the transport passage 302 to the outside of the image forming apparatus main body 12, reverses the recording sheet discharged to the outside of the image forming apparatus main body 12 and supplies the recording sheet again to the transport passage 302, is attached in the image forming apparatus main body 12. Further, a output tray 14 used as a discharge part, to which a recording sheet where an image is formed is discharged, is attached in the image forming apparatus main body 12. Further, a controller 400 is attached in the image forming apparatus main body 12.

The image forming part 30 is capable of forming plural color toner images by color on the photoreceptor drum 20. The image forming part 30 has a charging roller 32 used as a charging device to charge the surface of the photoreceptor drum 20, a latent image forming device 34 which emits light on the surface of the photoreceptor drum 20 charged with the charging roller 32 and forms a latent image on the surface of the photoreceptor drum 20, a developing device 100 which develops the latent image formed by the latent image forming device 34 on the surface of the photoreceptor drum 20 using developer and forms a toner image on the surface of the photoreceptor drum 20, a transfer device 200 which transfers the toner image formed by the developing device 100 on the surface of the photoreceptor drum 20 to a recording sheet, and a cleaning device 36 which scrape-removes developer remaining on the surface of the photoreceptor drum 20 after the transfer of the toner image by the transfer device 200 from the surface of the photoreceptor drum 20.

The transfer device 200 has a transfer roller 202 to which a transfer bias is added.

The developing device 100 has a yellow developing unit 120Y, a magenta developing unit 120M, a cyan developing unit 120C and a black developing unit 120K respectively to develop the latent image held on the photoreceptor drum 20 with yellow developer, magenta developer, cyan developer and black developer. The yellow developing unit 120Y, the magenta developing unit 120M, the cyan developing unit 120C and the black developing unit 120K respectively have developing rollers 122Y, 122M, 122C and 122K which are used as developer holders to rotate while holding the developer and supply the developer to the photoreceptor drum 20. The developing device 100 selects a developer placed in a developing position from the yellow developing unit 120Y, the magenta developing unit 120M, the cyan developing unit 120C and the black developing unit 120K. In FIG. 1, the yellow developing unit 120Y is placed in the developing position. Note that the developing position means a position of the developing unit 120 in which the developing roller 122 is placed in a position opposite to the photoreceptor drum 20. The latent image formed on the photoreceptor drum 20 is developed by the developing device 100 placed in the developing position. Note that the details of the developing device 100 will be described later.

The fixing device 50 is used for fixing the yellow toner image, the magenta toner image, the cyan toner image and the black toner image transferred with the transfer roller 202 on the recording sheet to the recording sheet. The fixing device 50 has a heating roller 54 having a heat generating member 52 inside and a pressure roller 56 pressed against the heating roller 54. The fixing device 50 heats the toner image and presses the toner image against the recording sheet.

The sheet supplying device 310 has a recording sheet container 312 containing plural recording sheets in a stacked state and a feed roller 314 used for feeding the top recording sheet of the stacked recording sheets in the recording sheet container 312 toward the transport passage 302.

The reverse device 330 has a bidirectionally rotatable discharge roller 332 and a switching member 334 which is used as a switching device to select guidance of the recording sheet transported from the fixing device 50 side of the transport passage 302 in the direction of the discharge roller 332 or the downstream side of the transport passage 302. The discharge roller 332 forward-rotates to discharge the recording sheet to which the toner image is fixed to the output tray 14. Further, the discharge roller 332 converts its rotation direction from the forward rotation to the reverse rotation when the discharge roller 332 is in contact with a part about a rear end of the recording sheet transported with the transport passage 302, thereby sends the recording sheet from the rear end side to the transport passage 302 while reversing the recording sheet.

As indicated with an arrow in FIG. 1, the transport passage 302 transports the recording sheet so as to circulate the recording sheet in the image forming apparatus main body 12. A feed roller 318, a registration roller 320, the above-described photoreceptor drum 20 and the transfer roller 202, the fixing device 50, the above-described switching member 334, a feed roller 322 and a feed roller 324 are attached along the transport passage 302 sequentially from a position where the sheet supplying device 310 is provided in a direction of transport of the recording sheet.

Further, in the transport passage 302, a recording sheet is supplied from the sheet supplying device 310 in a recording sheet supply position P1, a toner image formed on the photoreceptor drum 20 is transferred with the transfer roller 202 to the recording sheet in a transfer position P2, the toner image transferred with the transfer roller 202 to the recording sheet is fixed by the fixing device 50 to the recording sheet in a fixing position P3, and the recording sheet is discharged from the transport passage 302 in a discharge position P4.

Figure 2:
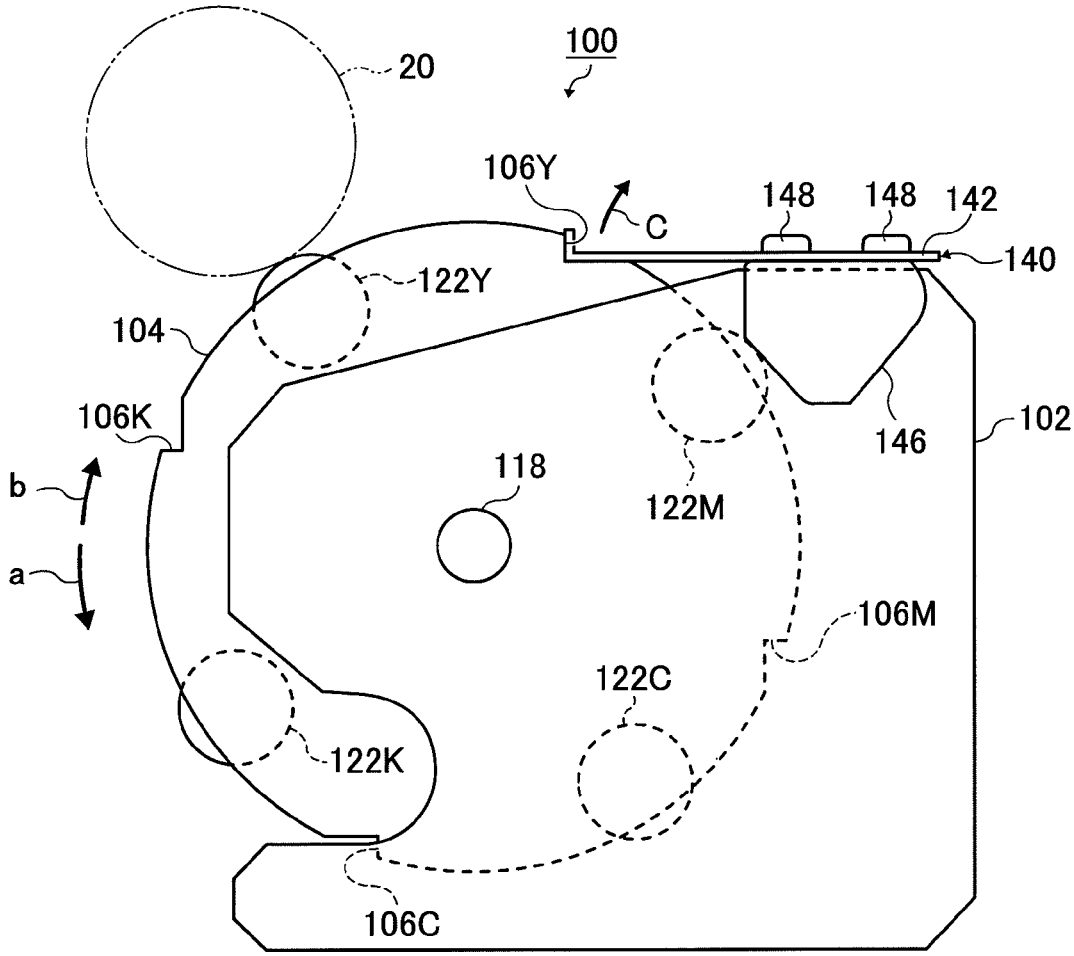
FIG. 2 is a right side cross-sectional view showing a developing device in the image forming apparatus shown in FIG. 1.
Figure 3:
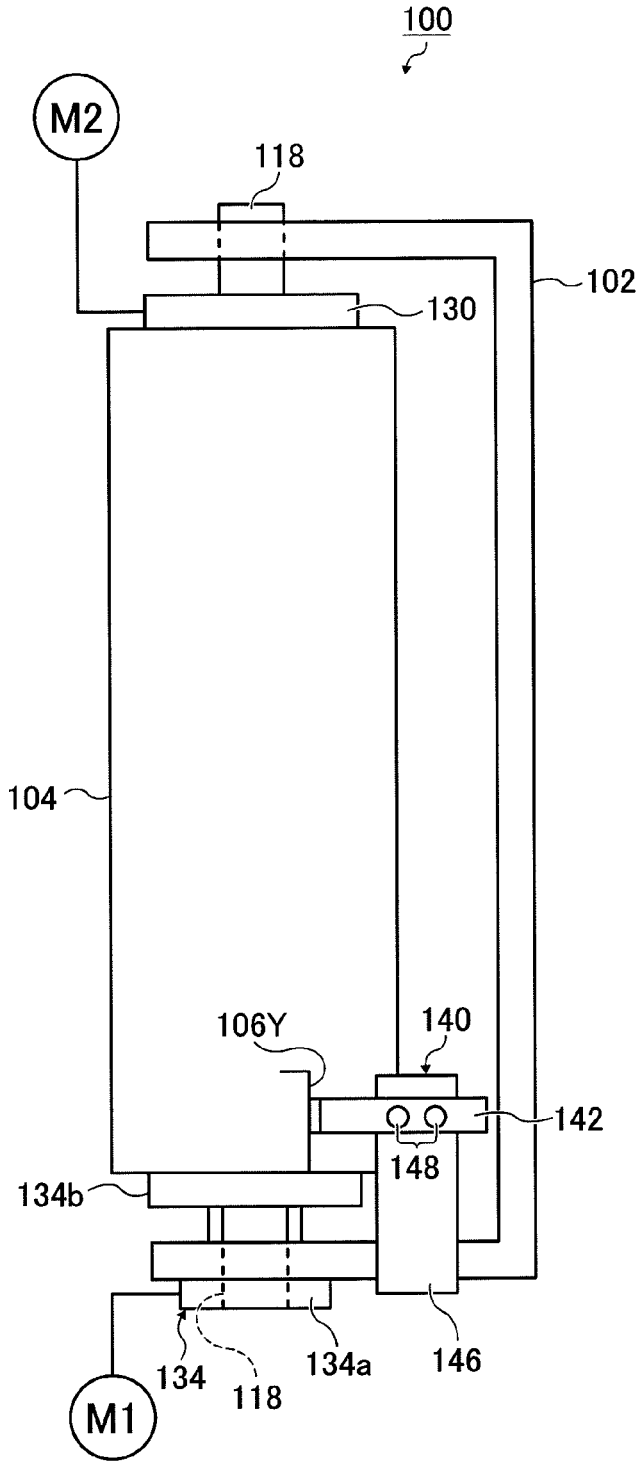
FIG. 3 is a plane view schematically showing the developing device shown in FIG. 2.

FIGS. 2 and 3 show the developing device 100.

As shown in FIGS. 2 and 3, the developing device 100 has a developing device main body 102, and a rotary body 104 is attached using a shaft 118 rotatably with respect to the developing device main body 102, in the developing device main body 102. The developing device main body 102 is attachable/removable in e.g. the image forming apparatus main body 12 (see FIG. 1).

The yellow developing unit 120Y, the magenta developing unit 120M, the cyan developing unit 120C and the black developing unit 120K (respectively, see FIG. 1) are attached to the rotary body 104, and the rotary body 104 is used as a rotary part which rotates such that one of these developing units (the yellow developing unit 120Y, the magenta developing unit 120M, the cyan developing unit 120C and the black developing unit 120K) is placed in the developing position to develop a latent image formed on the photoreceptor drum 20. When the developing unit used in development (the yellow developing unit 120Y, the magenta developing unit 120M, the cyan developing unit 120C or the black developing unit 120K) is changed, the rotary body 104 rotates in an arrow a direction shown in FIG. 2. Further, when driving from a motor M1 to be described later is transmitted via a developing roller driving mechanism 134 to be described later to the yellow developing unit 120Y, the magenta developing unit 120M, the cyan developing unit 120C and the black developing unit 120K and at least one of the yellow developing unit 120Y, the magenta developing unit 120M, the cyan developing unit 120C and the black developing unit 120K is driven, in accordance with the driving, the driving is transmitted to the rotary body 104, a rotational force is applied to the rotary body 104, and the rotary body 104 rotates in an arrow b direction as shown in FIG. 2 as a reverse direction of the arrow a direction as a rotation direction to change the above-described developing unit used in development.

In this manner, when the developing unit among the plural developing units (the yellow developing unit 120Y, the magenta developing unit 120M, the cyan developing unit 120C and the black developing unit 120K) placed in the developing position is changed, the rotary body 104 rotates in a reverse direction (the arrow a direction) of the direction (the arrow b direction) of rotation caused in accordance with driving of the yellow developing unit 120Y or the like, thereby the developing unit used in development is changed. Further, four concave portions 106Y, 106M, 106C and 106K are formed in the rotary body 104 such that a rotation regulatory member 142 to be described later is in contact with the concave portions.

When the rotary body 104 is positioned such that the rotation regulatory member 142 is in contact with the concave portion 106Y, the yellow developing unit 120Y is placed in the developing position and the developing roller 122Y is placed in the position opposite to the photoreceptor. Further, when the rotary body 104 is positioned such that the rotation regulatory member 142 is in contact with the concave portion 106M, the magenta developing unit 120M is placed in the developing position and the developing roller 122M is placed in the position opposite to the photoreceptor. Further, when the rotary body 104 is positioned such that the rotation regulatory member 142 is in contact with the concave portion 106C, the magenta developing unit 120C is placed in the developing position and the developing roller 122C is placed in the position opposite to the photoreceptor. Further, when the rotary body 104 is positioned such that the rotation regulatory member 142 is in contact with the concave portion 106K, the black developing unit 120K is placed in the developing position and the developing roller 122K is placed in the position opposite to the photoreceptor. Note that FIG. 2 shows the developing device 100 when the rotation regulatory member 142 is in contact with the concave portion 106Y, the yellow developing unit 120Y is placed in the developing position, and the developing roller 122Y of the yellow developing unit 120Y is opposite to the photoreceptor drum 20.

Further, the developing device 100 has a rotary body driving mechanism 130 to rotate the rotary body 104, and a developing roller driving mechanism 134 to drive the yellow developing unit 120Y, the magenta developing unit 120M, the cyan developing unit 120C and the black developing unit 120K and rotate the developing rollers 122Y, 122M, 122C and 122K. The rotary body driving mechanism 130 is used as a first driving unit to drive the rotary body 104. The driving mechanism 134 is used as a second driving unit to drive at least one of the developing units (the yellow developing unit 120Y, the magenta developing unit 120M, the cyan developing unit 120C and the black developing unit 120K).

The rotary body driving mechanism 130 is attached to e.g. the left side surface side (upper side in FIG. 3) of the rotary body 104, and is connected to the motor M2. The motor M2 is used as a driving source to transmit driving to the rotary body driving mechanism 130.

The developing roller driving mechanism 134 has a main body attachment member 134*a* attached to a side plate on the right side (lower side in FIG. 3) of the developing device main body 102 and a rotary body attachment member 134*b* attached to a surface on the right side (lower side in FIG. 3) of the rotary body 104. The developing roller driving mechanism 134, connected to the motor M1 used as a driving source, transmits driving of the motor M1 to the developing units (the yellow developing unit 120Y, the magenta developing unit 120M, the cyan developing unit 120C and the black developing unit 120K) to rotate the developing rollers 122Y, 122M, 122C and 122K.

Further, the developing device 100 has a regulatory mechanism 140.

The regulatory mechanism 140 is used as a position regulatory mechanism to regulate the position of the rotary body 104 using a rotational force caused in the rotary body 104 in accordance with the driving of the developing roller driving mechanism 134. Further, the regulatory mechanism 140 has the rotation regulatory member 142 used as a positioning part to set the rotary body 104 and a support body 146 to support the rotation regulatory member 142.

The rotation regulatory member 142, which is e.g. a flexible member, has flexibility and elasticity. The rotation regulatory member 142 is formed of e.g. metal. Further, when the rotary body 104 starts rotation in the arrow b direction in accordance with driving of at least one of the yellow developing unit 120Y, the magenta developing unit 120M, the cyan developing unit 120C and the black developing unit 120K, the rotation regulatory member 142 comes into contact with one of the four concave portions 106Y, 106M, 106C and 106K, to regulate the rotation of the rotary body 104 in the arrow b direction. That is, in the present exemplary embodiment, one of the concave portions 106Y, 106M, 106C and 106K is pressed against the rotation regulatory member 142 using the rotational force in the rotational direction indicated as the arrow b direction in FIG. 2 caused in the rotary body 104 by application of rotational moment to the rotary body 104 and application of inertia to the rotary body 104 in accordance with the driving by the developing roller driving mechanism 134, thereby the position of the rotary body 104 is regulated.

In this case, the rotary body 104 may be regulated with only this operation, or when the position of the rotary body 104 is held by the motor M2, the operation may be subsidiarily used.

The support body 146 is attached to e.g. a right side (lower side in FIG. 3) wall of the developing device main body 102. Further, one end side of the rotation regulatory member 142 is secured to the support body 146 using e.g. screws 148. Accordingly, the opposite side of the rotation regulatory member 142 to the side secured with the screws 148 can be deformed and is pressed against e.g. the rotary body 104, thereby is deformed to be distorted in e.g. an arrow c direction in FIG. 2.

In the developing device 100 having the above structure as described above, the regulatory mechanism 140 regulates the rotation of the rotary body 104 in the arrow b direction in accordance with the driving of the yellow developing unit 120Y or the like. On the other hand, the regulatory mechanism 140 allows the rotation of the rotary body 104 in the arrow a direction in accordance with the change of developing unit placed in the developing position. That is, when the rotary body 104 rotates in the arrow a direction, the rotation regulatory member 142 is distorted so as to run upon the side surface of the rotary body 104 which is a surface continued from the concave portion 106 and in which the concave portion 106 is not formed, and is deformed as indicated with the arrow c, thereby the rotation of the rotary body 104 is not regulated, and the rotation of the rotary body 104 is not stopped.

Figure 4:
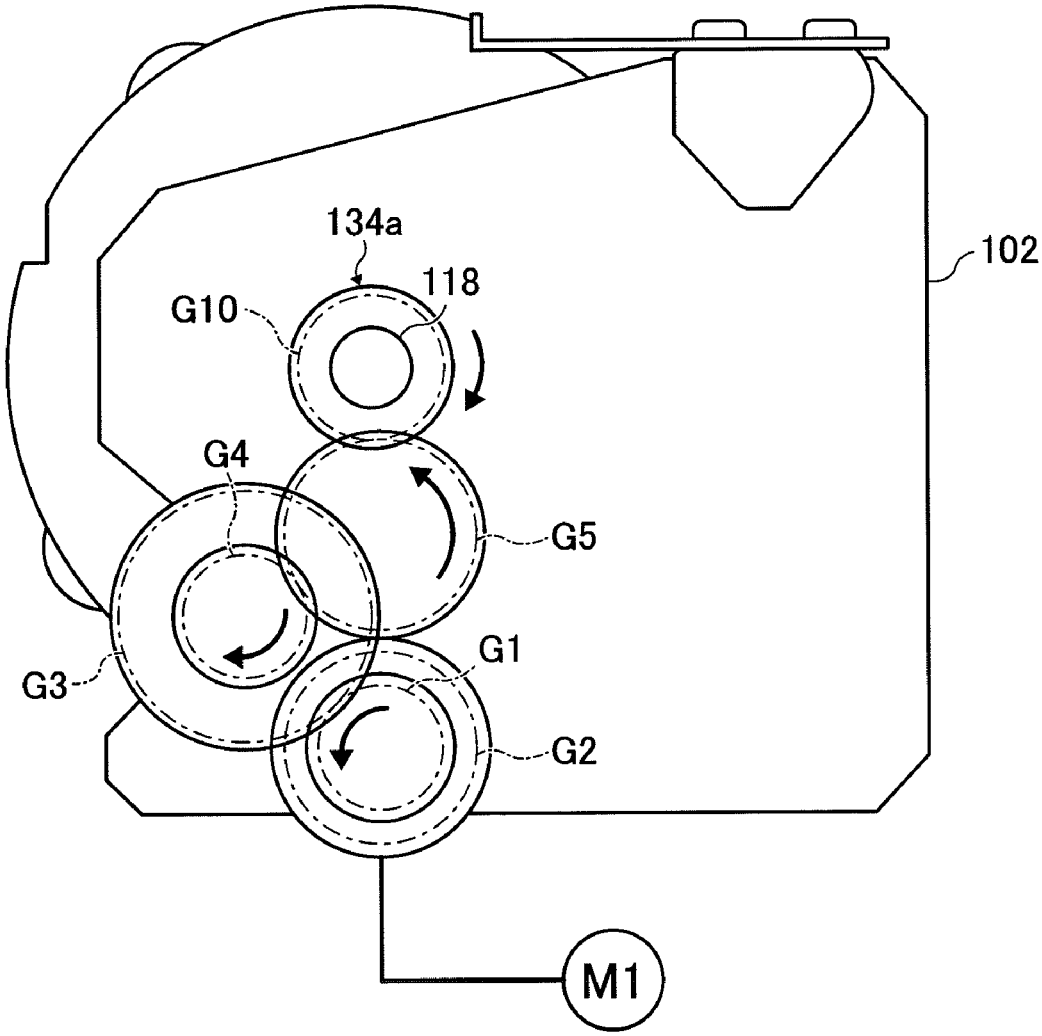
FIG. 4 is a first view showing a developing roller driving mechanism attached to the developing device shown in FIG. 2.

FIG. 4 shows the main body attachment member 134*a* of the developing roller driving mechanism 134.

The main body attachment member 134*a* has a gear G1 which rotates upon reception of driving transmitted from the motor M1, a gear G2 which is connected to the gear G1 and which rotates integrally with the gear G1, a gear G3 which is engaged with the gear G2 and which rotates upon reception of driving transmitted from the gear G2, a gear G4 which is connected to the gear G3 and which rotates integrally with the gear G3, a gear G5 which is engaged with the gear G4 and which rotates upon reception of driving transmitted from the gear G4, and a gear G10 which is engaged with the gear G5 and which rotates upon reception of driving transmitted from the gear G5. The gears G1, G2, G3, G4 and G5 are rotatably attached to e.g. the right side surface (lower side surface in FIG. 3) of the developing device main body 102. Further, the gear G10 is rotatably attached to the shaft 118. Note that the direction of rotation of the gear G10 is the same as the arrow b direction shown in FIG. 2, which is the rotational direction of the rotary body 104 by driving of at least one of the yellow developing unit 120Y, the magenta developing unit 120M, the cyan developing unit 120C and the black developing unit 120K, transmission of the driving in accordance with the driving and application of rotational force to the rotary body 104.

Figure 5:
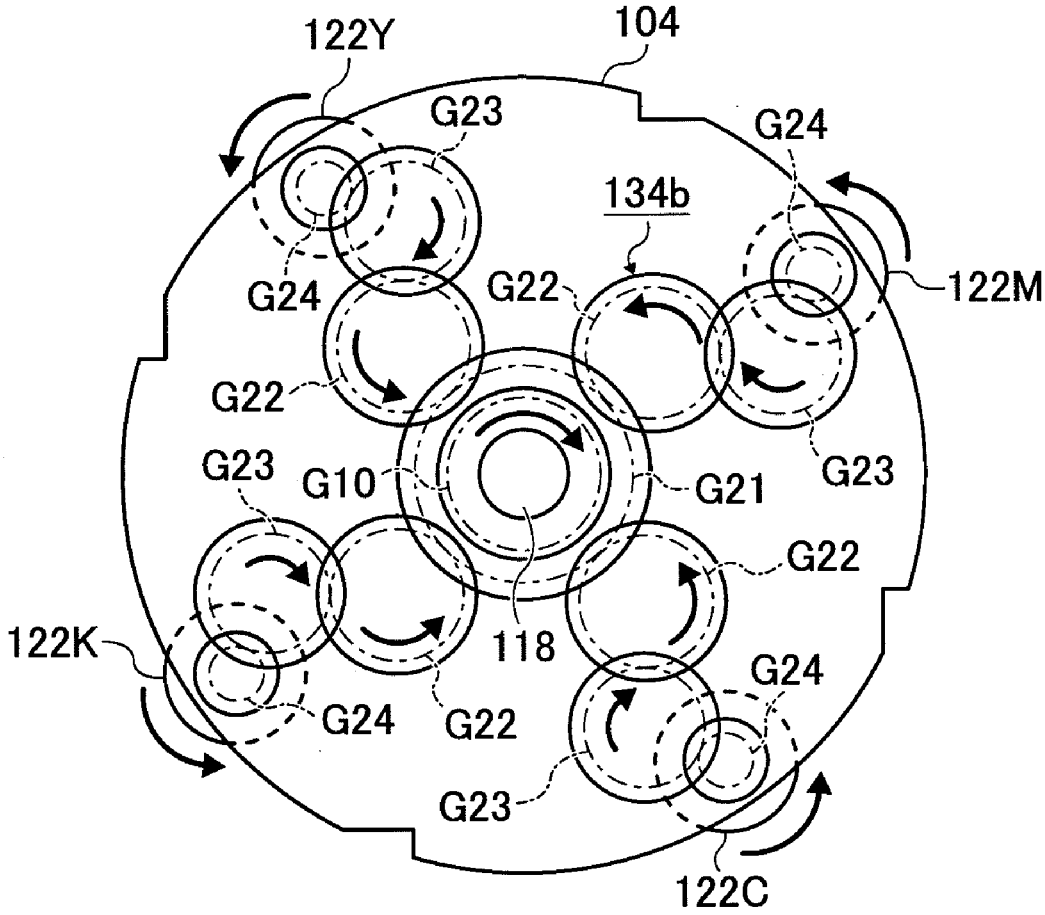
FIG. 5 is a second view showing the developing roller driving mechanism attached to the developing device shown in FIG. 2.

FIG. 5 shows the rotary body attachment member 134*b* of the developing roller driving mechanism 134.

The rotary body attachment member 134*b* has a gear G21 which is connected to the above-described gear G10 (see FIG. 4) and which rotates integrally with the gear G10, four gears G22 which are engaged with the gear G21 and which rotate upon reception of driving transmitted from the gear G21, four gear G23 which are respectively engaged with the four gears G22 and which respectively rotate upon reception of driving transmitted from the four gears G22, and four gears G24 which are respectively engaged with the four gears G23 and which respectively rotate upon reception of driving transmitted from the four gears G23.

The four gears G24 are respectively connected to the developing rollers 122Y, 122M, 122C and 122K, and the developing rollers 122Y, 122M, 122C and 122K respectively rotate integrally with the four gears G24. The gear G21 is rotatably attached to the shaft 118. Further, the four gears G22, the four gears G23 and the four gears G24 are rotatably attached to the right side (lower side in FIG. 3) surface of the rotary body 104.

Figure 6:
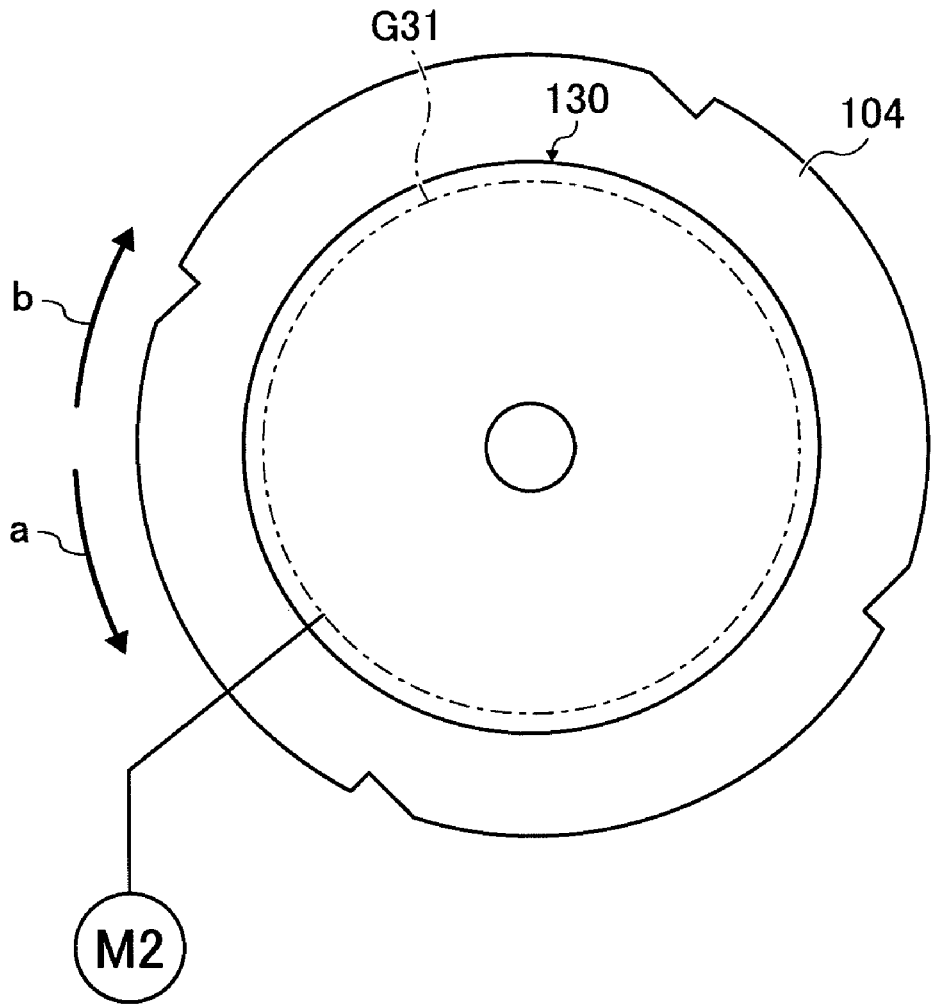
FIG. 6 illustrates a rotary body driving mechanism attached to the developing device shown in FIG. 2.

FIG. 6 shows the rotary body driving mechanism 130.

The rotary body driving mechanism 130 has a gear G31 which rotates by driving transmitted from the motor M2 via e.g. another gear. The gear G31 is fixed to the left side (upper side in FIG. 3) surface of the rotary body 104. Accordingly, the rotary body 104 rotates upon reception of driving transmitted from the motor M2 integrally with the gear G31. The rotational direction of the rotary body 104 is controlled by e.g. control of the rotational direction of the motor M2, and the rotary body 104 can rotate in both arrow a and arrow b directions. It may be arranged such that in place of changing the rotational direction of the motor M2, the driving is transmitted to the gear G31 via a clutch (not shown) as a part of the rotary body driving mechanism 130 having a function of converting the rotation from the motor M2 to a reverse direction, thereby the rotational direction of the rotary body 104 is changed using the clutch.

Figure 7:
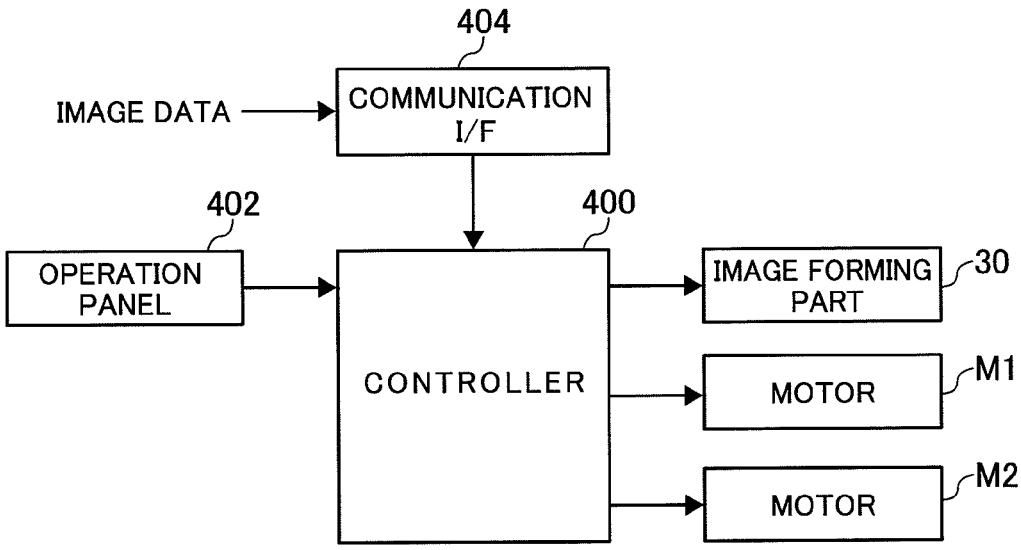
FIG. 7 is a block diagram showing a controller of the image forming apparatus shown in FIG. 1.

FIG. 7 shows the controller 400.

The controller 400 has a control circuit such as a CPU. Image data is inputted into the controller 400 via a communication interface 404. Further, an output from the operation panel 402 is inputted into the controller 400, and the image forming part 30, the motor M1, the motor M2 and the like are controlled with outputs from the controller 400. Further, the controller 400 is used as a controller to control at least one of the clutch (not shown) having the function of converting the rotation from the motor M2 into a reverse direction and the motor M2 such that when one of the plural developing units (the yellow developing unit 120Y, the magenta developing unit 120M, the cyan developing unit 120C and the black developing unit 120K) has rotated so as to pass through the developing position, the rotary body 104 rotates in the direction caused in accordance with the driving of at least one of these plural developing units, and the rotation is regulated and positioned by the regulatory mechanism 140.

Figure 8:
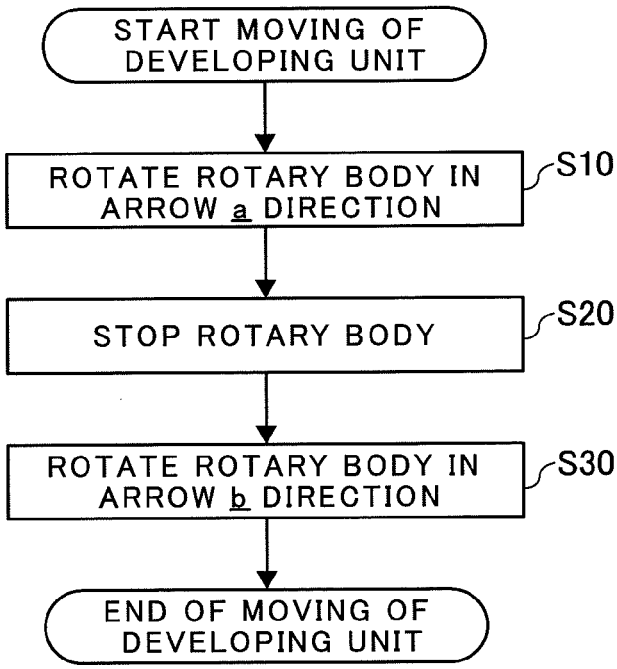
FIG. 8 is a flowchart showing an operation to change a developing unit used in development in the image forming apparatus shown in FIG. 1.
Figure 9A:
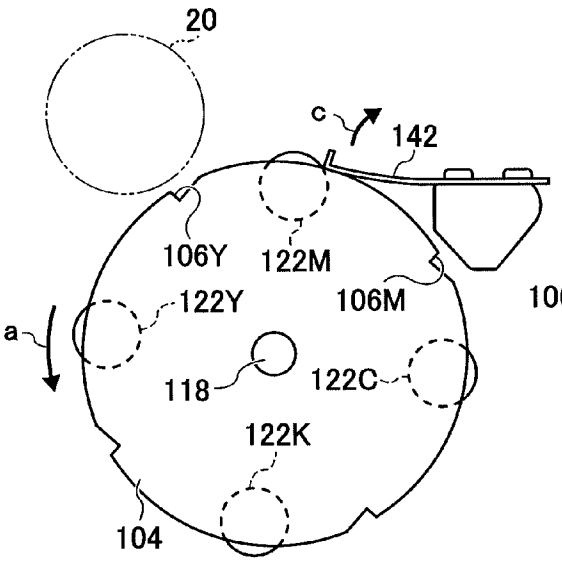
FIGS. 9A to 9C are explanatory views of the operation to change the developing unit used in development in a rotary body of the developing device shown in FIG. 2.

FIG. 8 is a flowchart showing an operation to change the developing unit placed in the developing position among the plural developing units (the yellow developing unit 120Y, the magenta developing unit 120M, the cyan developing unit 120C and the black developing unit 120K). Further, FIGS. 9A to 9C are explanatory views of the operation to change the developing unit in the developing position, with an operation to change a state where the yellow developing unit 120Y is placed in the developing position to a state where the magenta developing unit 120M is placed in the developing position, as an example.

For example, in the example where the state where the yellow developing unit 120Y placed in the developing position is changed to the state where the magenta developing unit 120M placed in the developing position, as shown in FIG. 8, at first step S10, the controller 400 controls the motor M2 to rotate the rotary body 104 in the arrow a direction. Then the yellow developing unit 120Y is placed in the developing position, the developing roller 122Y is opposite to the photoreceptor drum 20, and the rotary body 104 starts rotation in a state where the rotation regulatory member 142 is in contact with the concave portion 106Y (see FIGS. 1 and 2). As shown in FIG. 9A, the rotation regulatory member 142 is deformed to be distorted in the arrow c direction so as to run upon a position between the concave portion 106Y and the concave portion 106M of the rotary body 104.

Figure 9B:
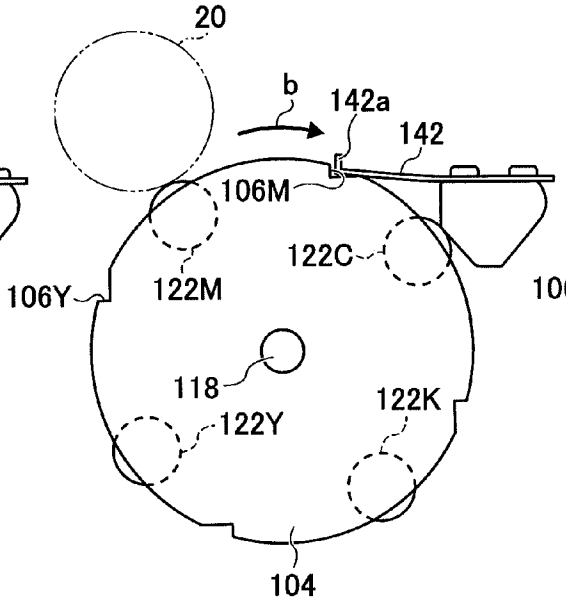
Figure 9C:
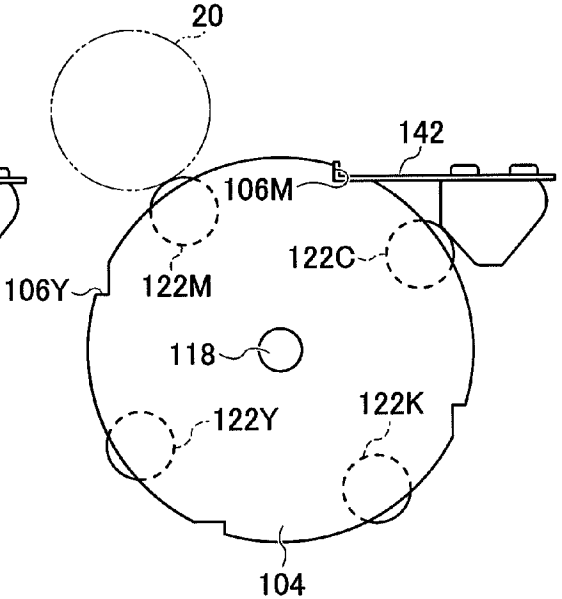

From this state, when the controller 400 controls the motor M2 to continue the rotation of the rotary body 104 in the arrow a direction, the concave portion 106M slightly passes a front side (left side in FIG. 9B) end 142*a* of the rotation regulatory member 142 as shown in FIG. 9B. When the concave portion 106M has slightly passed the front side end 142*a* of the rotation regulatory member 142, then at step S20, the controller 400 controls the motor M2 to stop the rotation of the rotary body 104.

At step S30, the controller 400 controls the motor M2 to rotate the rotary body 104 in the arrow b direction. Then the concave portion 106M of the rotary body 104 comes in contact with the end 142*a* of the rotation regulatory member 142, and the rotary body 104 is positioned in the position where the concave portion 106M is in contact with the end 142*a* of the rotation regulatory member 142, as shown in FIG. 9C. In this manner, in the position where the rotary body 104 is positioned, the magenta developing unit 120M is placed in the developing position, and the developing roller 122M is placed in the position opposite to the photoreceptor drum 20. As shown in FIG. 9C, when the concave portion 106M comes in contact with the front side end 142*a* of the rotation regulatory member 142, since the rotation regulatory member 142 has flexibility, the rotation regulatory member 142 is deformed to be distorted, thereby the shock upon contact between the rotary body 104 and the rotation regulatory member 142 is mitigated.

In the above description, the controller 400 controls the motor M2 to rotate the rotary body 104 in the arrow a direction at step S10, stop the rotary body 104 at step S20, and rotate the rotary body 104 in the arrow b direction at step S30. On the other hand, when the rotary body driving mechanism 130 has a clutch having a function of converting the rotation from the motor M2 into a reverse direction, it may be arranged such that in place of control of the motor M2 by the controller 400, the clutch is controlled by the controller 400. Further, the controller 400 may control both the clutch and the motor M2.

In the image forming apparatus 10 according to the first exemplary embodiment having the above structure, when a single color image such as black-and-white image is formed, a toner image formed by the image forming part 30 on the surface of the photoreceptor drum 20 is transferred with the transfer roller 202 to a recording sheet, the toner image transferred on the recording sheet is fixed by the fixing device 50 to the recording sheet, and the recording sheet to which the toner image is fixed is discharged with the discharge roller 332 to the output tray 14.

On the other hand, when a multiple-color image is formed in the image forming apparatus 10 according to the first exemplary embodiment having the above structure, a recording sheet on which a yellow toner image has been transferred is transported with the transport passage 302 to the transfer position P2 again, then a magenta toner image is transferred so as to be overlaid on the yellow toner image fixed on the recording sheet. At this time, the image forming part 30 forms the magenta toner image on the surface of the photoreceptor drum 20, and in formation of the magenta toner image, the rotary body 104 of the developing device 100 rotates as described above and the magenta developing unit 120M is placed in the developing position, the developing roller 122M is placed in the position opposite to the photoreceptor drum 20, and the latent image formed on the photoreceptor drum 20 is developed with magenta developer supplied with the developing roller 122M.

Then the magenta toner image transferred on the recording sheet is fixed by the fixing device 50 to the recording sheet. Thereafter, similarly to the transfer and fixing of the magenta toner image to the recording sheet, a cyan toner image is transferred to the recording sheet and the cyan toner image is fixed to the recording sheet, and further, a black toner image is transferred to the recording sheet and the black toner image is fixed to the recording sheet.

Figure 10:
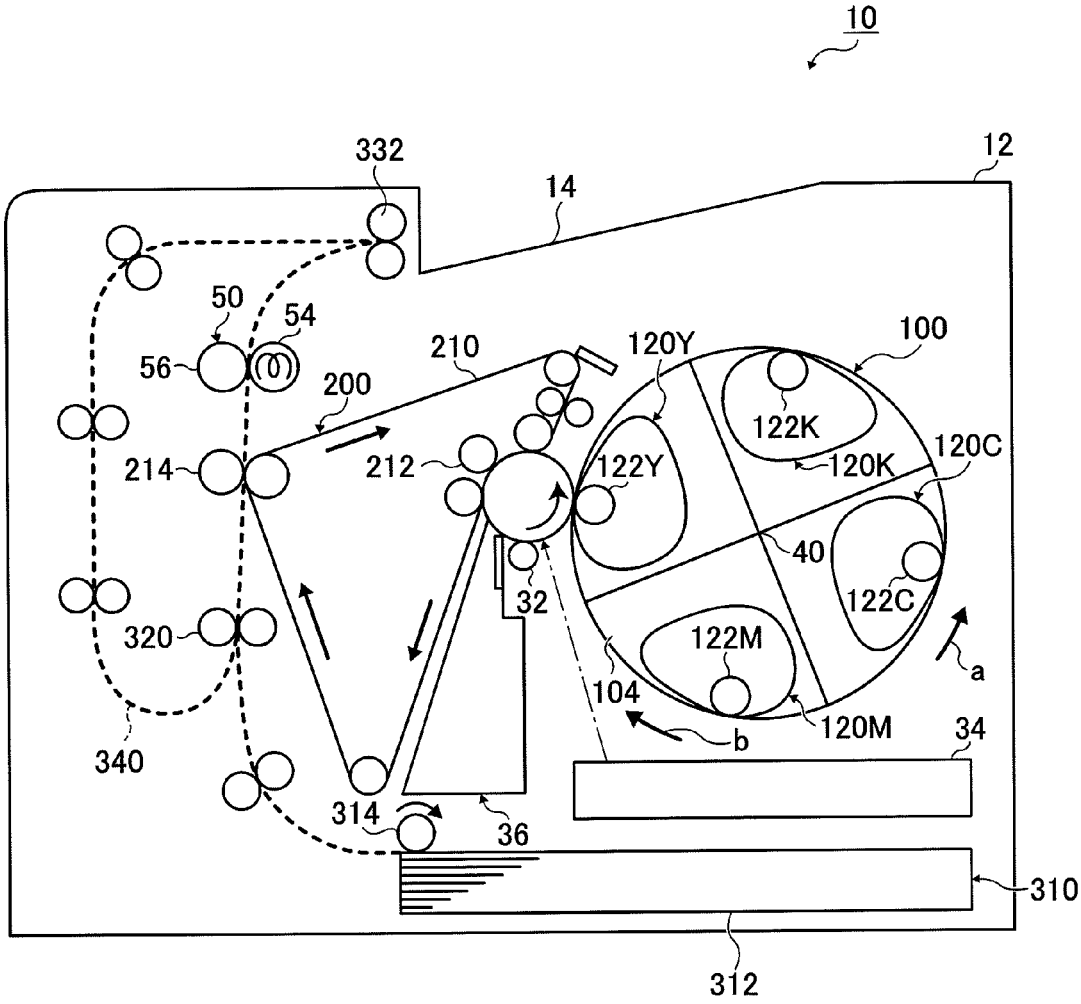
FIG. 10 is a right side cross-sectional view showing the image forming apparatus according to a second exemplary embodiment of the present invention.

FIG. 10 shows the image forming apparatus 10 according to a second exemplary embodiment of the present invention.

The transfer device 200 of the image forming apparatus 10 according to the above-described first exemplary embodiment has the transfer roller 202, and a toner image formed on the photoreceptor drum 20 is directly transferred with the transfer roller 202 onto a recording sheet. On the other hand, the transfer device 200 of the image forming apparatus 10 according to the second exemplary embodiment has an intermediate transfer belt 210 used as a transfer medium and used as an intermediate transfer body. A toner image is transferred from the photoreceptor drum 20 to the intermediate transfer belt 210, and then the toner image is transferred from the intermediate transfer belt 210 to a recording sheet.

As shown in FIG. 10, the image forming apparatus 10 according to the second exemplary embodiment has a first transfer roller 212 and a second transfer roller 214 in addition to the intermediate transfer belt 210. The first transfer roller 214 is used for transfer of a toner image formed on the photoreceptor drum 20 to the intermediate transfer belt 210. The second transfer roller 214 is used for transfer of the toner image transferred on the intermediate transfer belt 210 to a recording sheet.

Upon formation of a multiple-color image, in the image forming apparatus 10 according to the above-described first exemplary embodiment, toner images formed with mutually different color developers are transferred so as to be overlaid on a recording sheet. On the other hand, in the image forming apparatus 10 according to the second exemplary embodiment, in formation of a multiple-color image, toner images formed with mutually different color developers are transferred so as to be overlaid on the intermediate transfer belt 210, and the toner images overlaid on the surface of the intermediate transfer belt 210 are transferred to a recording sheet at once.

Further, in the image forming apparatus 10 according to the above-described first exemplary embodiment, in image formation on both sides of a recording sheet, the recording sheet is reversed by the reverse device 330. The image forming apparatus 10 according to the second exemplary embodiment has a reverse transport passage 340, and in formation of image on both sides of a recording sheet, the recording sheet is reversed with the reverse transport passage 340.

In the image forming apparatus 10 according to the second exemplary embodiment, elements corresponding to those of the image forming apparatus 10 according to above-described the first exemplary embodiment have the same reference numerals as those assigned in the image forming apparatus 10 according to the first exemplary embodiment in FIG. 10, and the explanations of the elements will be omitted.

As described above, the present invention is applicable to an image forming apparatus such as a copier, a printer or a facsimile apparatus, and a developing device used in e.g. such image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a plurality of developing units;

a rotary body, where the plurality of developing units are attached, that rotates so as to place one of the plurality of developing units in a developing position to develop a subject of development;

a first driving unit that drives the rotary body;

a second driving unit that drives at least one of the plurality of developing units; and a regulatory mechanism that regulates a position of the rotary body using a rotational force caused in the rotary body in accordance with driving by the second driving unit.

2. The developing device according to claim 1, wherein, when a developing unit among the plurality of developing units placed in the developing position is changed, the rotary body rotates in a reverse direction of a rotational direction caused in accordance with driving of at least one of the plurality of developing units, and the regulatory mechanism allows rotation of the rotary body in a direction to change the developing unit among the plurality of developing units placed in the developing position.

3. The developing device according to claim 2, wherein, when the rotary body has rotated so as to pass one of the plurality of developing units through the developing position, the rotary body rotates in a direction caused in accordance with driving of at least one of the plurality of developing units, and the rotation is regulated and positioned by the regulatory mechanism.

4. The developing device according to claim 2, wherein the regulatory mechanism has a positioning part that sets the rotary body, and the positioning part allows rotation of the rotary body in a direction to change the developing unit placed in the developing position.

5. The developing device according to claim 3, wherein the regulatory mechanism has a positioning part that sets the rotary body, and the positioning part allows rotation of the rotary body in a direction to change the developing unit placed in the developing position.

6. An image forming apparatus comprising:

an image holding member that holds at least a latent image;

a developing device that develops the latent image held on the image holding member and forms a toner image; and a transfer device that transfers the toner image formed by the developing device to a transfer medium, the developing device having:

a plurality of developing units;

a rotary body, where the plurality of developing units are attached, that rotates so as to place one of the plurality of developing units in a developing position to develop a subject of development;

a first driving unit that drives the rotary body;

a second driving unit that drives at least one of the plurality of developing units; and a regulatory mechanism that regulates a position of the rotary body using a rotational force caused in the rotary body in accordance with driving by the second driving unit.

7. The image forming apparatus according to claim 6, further comprising:

a driving source that transmits driving to the first driving unit; and a controller that controls at least one of the first driving unit and the driving source so as to rotate the rotary body to rotate one of the plurality of developing units so as to pass through the developing position, then rotate the rotary body in a direction caused in accordance with driving of at least one of the plurality of developing units, and regulate and position the rotation by the regulatory mechanism.

* * * * *